US007503777B2

(12) United States Patent
Ko et al.

(10) Patent No.: US 7,503,777 B2
(45) Date of Patent: Mar. 17, 2009

(54) ELECTRICAL CONNECTOR WITH IMPROVED CONTACTS

(75) Inventors: David Tso-Chin Ko, Cypress, CA (US); Xue-Yuan Xiao, Kunshan (CN); Shu-Qiang Zhao, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/888,588

(22) Filed: Aug. 1, 2007

(65) Prior Publication Data

US 2008/0032552 A1 Feb. 7, 2008

Related U.S. Application Data

(63) Continuation-in-part of application No. 11/580,608, filed on Oct. 12, 2006, now Pat. No. 7,442,057.

(30) Foreign Application Priority Data

Aug. 1, 2006 (CN) ..... 2006 2 0076133

(51) Int. Cl.
*H01R 4/66* (2006.01)

(52) U.S. Cl. ..... 439/108

(58) Field of Classification Search ..... 439/581, 439/108, 608, 101, 502, 660, 345, 74, 571
See application file for complete search history.

(56) References Cited

U.S. PATENT DOCUMENTS

| | | | | |
|---|---|---|---|---|
| 5,863,217 | A | 1/1999 | Ii | |
| 6,280,209 | B1 * | 8/2001 | Bassler et al. | 439/101 |
| 6,343,951 | B1 * | 2/2002 | Ono et al. | 439/571 |
| 6,379,165 | B1 * | 4/2002 | Lee | 439/108 |
| 6,447,311 | B1 * | 9/2002 | Hu et al. | 439/108 |
| 6,875,027 | B2 * | 4/2005 | Ye et al. | 439/74 |
| 7,083,464 | B2 | 8/2006 | Liu | |

* cited by examiner

*Primary Examiner*—Edwin A. Leon
(74) *Attorney, Agent, or Firm*—Wei Te Chung

(57) ABSTRACT

An electrical connector (100) includes an insulative housing (1) for receiving a number of contacts (2), and a metal shield (3) enclosing the insulative housing (1). The insulative housing has a rear portion (11) and a pair of side portions (12, 17) extending from the rear portion with a receiving space (18) formed therebetween. The rear portion comprises a pair of upper and lower tongue plates (13, 14) extending forwardly into the receiving space with a mating slot (15) formed therebetween. The upper and lower tongue plates respectively define a plurality of parallel passageways (131, 141). Each contact has a body portion (21) retained in the rear portion, and an upper and a lower section (221, 222) received in the passageways. The upper section (221) has a contact portion (2211) extending into the mating slot for electrically connecting with a plug.

20 Claims, 7 Drawing Sheets

ELECTRICAL CONNECTOR WITH IMPROVED CONTACTS

CROSS-REFERENCE TO RELATED APPLICATIONS

This is a continuation-in-part application of U.S. patent application Ser. No. 11/580,608 filed on Oct. 12, 2006 now U.S. Pat. No. 7,442,057 and relates to a contemporaneously filed application entitled "ELECTRICAL CONNECTOR WITH RELIABLE MATING FRAME MATING WITH ANOTHER CONNECTOR", having the same assignee with the instant invention.

BACKGROUND OF THE INVENTION

1. Field of the Invention

This invention generally relates to an electrical connector, and more particularly to a high frequency electrical connector.

2. Description of the Prior Art

A high frequency electrical connector such as a radio frequency (RF) electrical connector disclosed in U.S. Pat. No. 6,533,610 B1, includes a hollow columned shell, a columned center contact and an insulative housing disposed between the shell and the center contact. The shell defines a columned receiving space. The center contact is retained in the insulative housing with a contact portion cantilevered extending into the receiving space. However, the center contact is difficult to manufacture because the columned configuration of the center contact is relative complex to be stamped from a metal sheet. Besides, the center contact is solely retained by the way of its rear portion engaging with the insulative housing. Such an arrangement of the center contact does not provide strong resistance to external forces that occur when a mating connector is inserted into or removed from the RF electrical connector. More over, it is probable difficult to assure the shell coaxially positioned with the center contact, because the contact portion extends cantilevered into the receiving space. Further more, the conventional RF electrical connector can only transmit a single signal because it has only one center contact. With the development of electronics, multiple signal transmission is highly desired currently.

Hence, it is desired to have an electrical connector solving the problem above.

BRIEF SUMMARY OF THE INVENTION

Accordingly, an object of the present invention is to provide an electrical connector which can transmit more than one signal at one time and has low cost contacts for mating with a corresponding plug.

In order to attain the objective above, an electrical connector includes an insulative housing for receiving a plurality of contacts, and a metal shield enclosing the insulative housing. The insulative housing has a rear portion and a pair of side portions extending from the rear portion with a receiving space formed therebetween. The rear portion comprises a pair of upper and lower tongue plates extending forwardly into the receiving space with a mating slot formed between the upper and lower tongue plates. The upper and lower tongue plates define a plurality of upper and lower passageways, respectively. The lower passageways align with the upper passageways in a vertical direction. Each contact has a body portion retained in the rear portion, an upper and a lower section extending from an end of the body portion, and a soldering tail extending from another end of the body portion. The upper and lower sections are respectively received in the upper and lower passageways. The upper section has a contact portion protruding into the mating slot for electrically connecting with a plug. The metal shield has a top wall and a pair of side walls abutting against the pair of side portions of the insulative housing. With this arrangement, the contacts have simple configuration and can be stamped from a metal sheet, thereby facilitating the manufacture of the contacts. Further, the electrical connector can transmit multiple signals simultaneously with the plurality of contacts.

Other objects, advantages and novel features of the invention will become more apparent from the following detailed description of the present embodiment when taken in conjunction with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Reference will now be made in detail to the preferred embodiment of the present invention.

Figure 1:
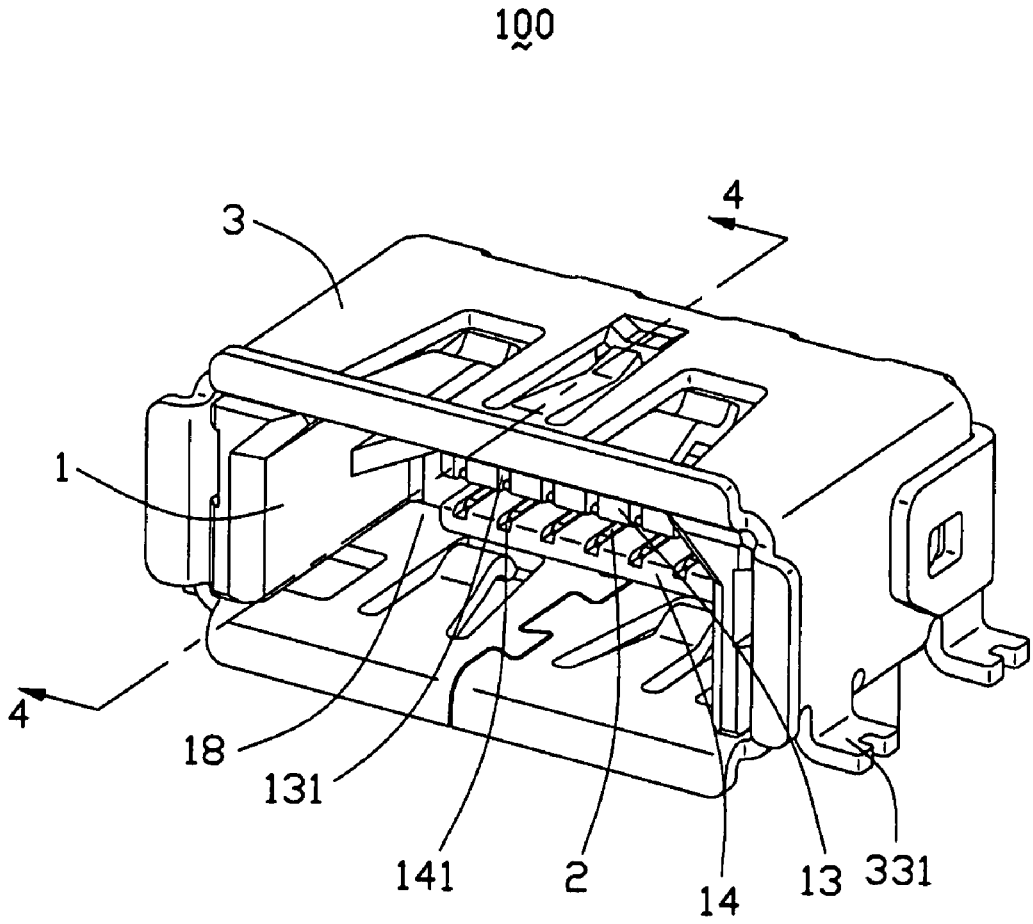
FIG. 1 is a perspective view of an electrical connector according to an embodiment of the present invention.
Figure 2:
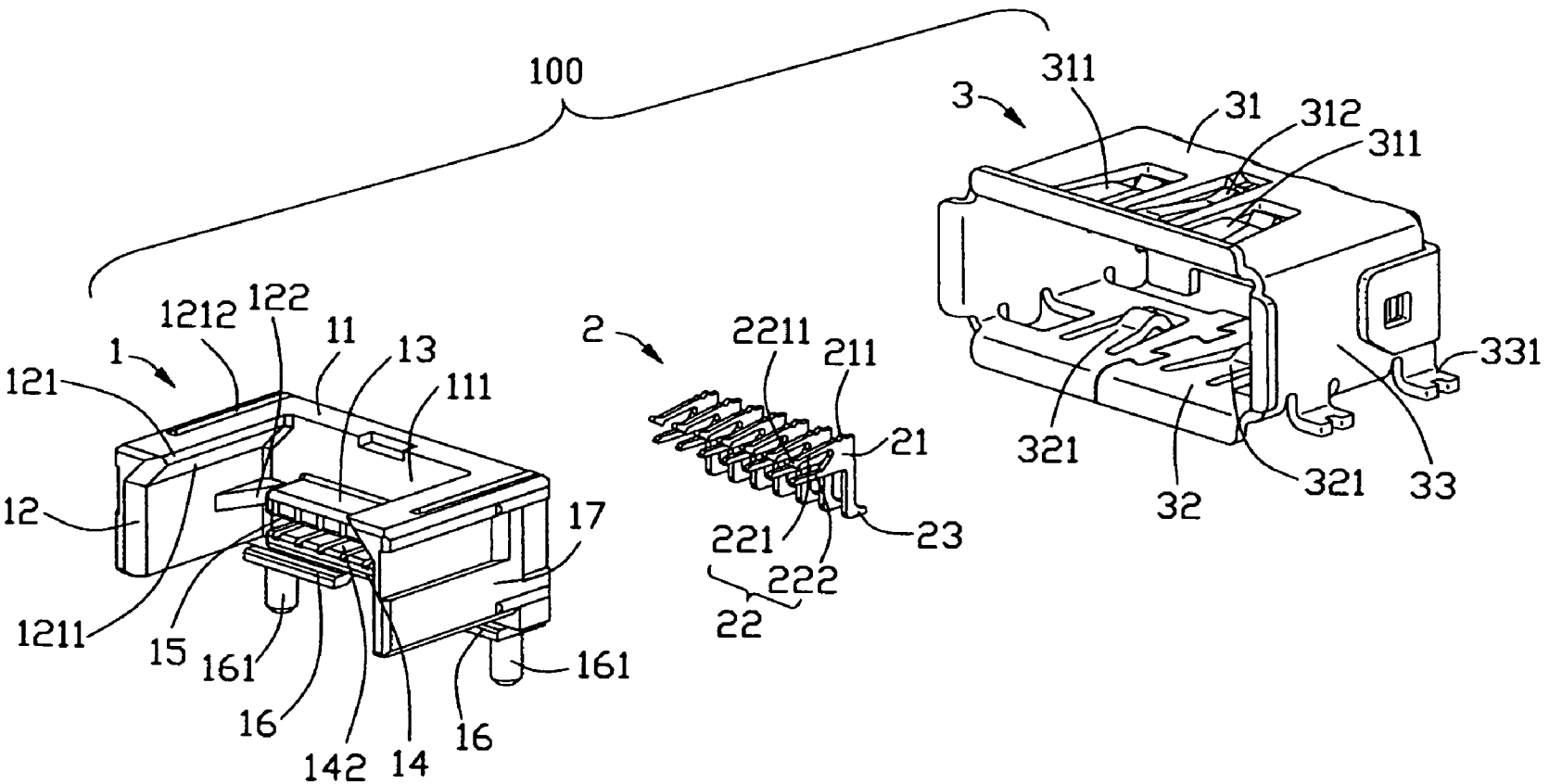
FIG. 2 is an exploded view of the electrical connector shown in FIG. 1.
Figure 3:
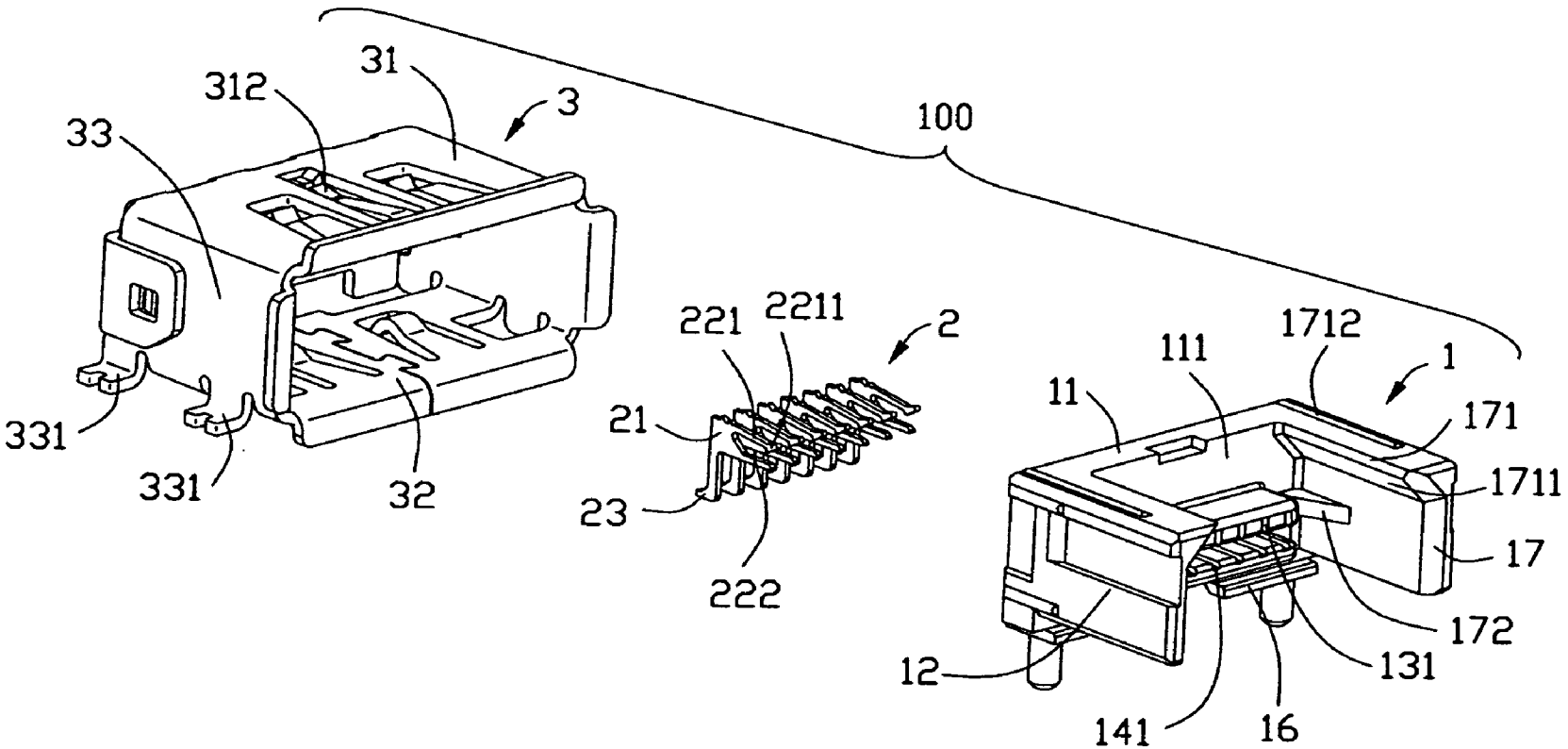
FIG. 3 is similar to FIG. 2, but viewed from another aspect.

Referring to FIGS. 1 to 3, an electrical connector 100 mounted on a printed circuit board 7 (PCB, shown in FIG. 6) for mating with a corresponding plug 200. The electrical connector 100 comprises an insulative housing 1, a plurality of contacts 2 retained in the insulative housing 1 and a metal shield 3 enclosing the insulative housing 1. The electrical connector 100 in the preferred embodiment is a RF electrical connector.

Figure 4:
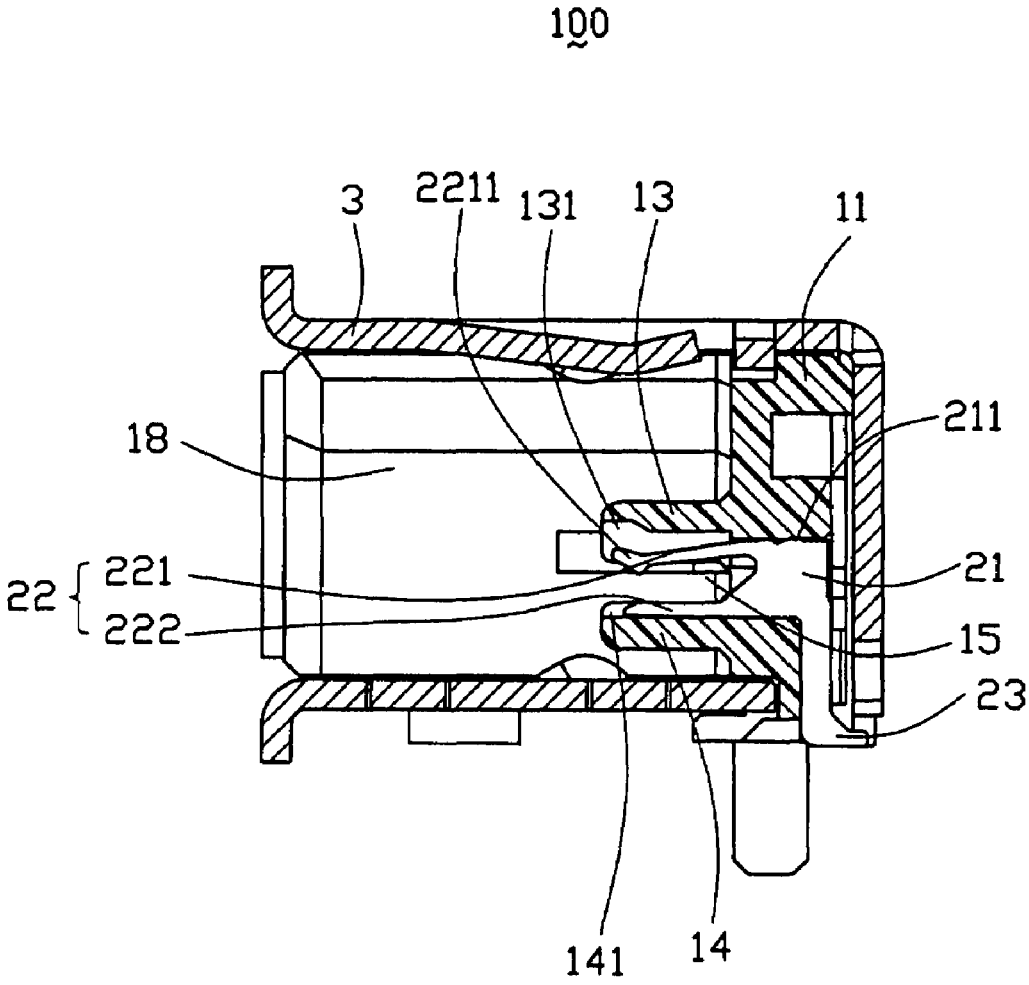
FIG. 4 is a cross sectional view taken along line 4-4 of FIG. 1.

Further referring to FIG. 4 in conjuction with FIGS. 2 and 3, the insulative housing 1 includes a rear portion 11, a first and a second side portion 12, 17 extending forwardly from opposite lateral sides of the rear portion 11, and a receiving space 18 disposed between the first and second side portions 12, 17. The rear portion 11 has a front face 111, a pair of first and second tongue plates 13, 14 integrally projecting forwardly from middle of the front face 111 and extending into the receiving space 18. The first and second tongue plates 13, 14 are probably of the same configuration and disposed parallel to each other. The first and second tongue plates 13, 14 are aligned with each other along a vertical direction, wherein the first tongue plate 13 is positioned over the second tongue plate 14. The metal shield 3 has a mating face (not labeled) at a front end thereof. The first and second tongue plates 13, 14 have a distal end (not labeled) located in the receiving space 18, wherein the distance between the distal end and the mating face is farther than that of the distal end and the front face 111 of the rear portion 11. A horizontal mating slot 15 is disposed between and separates the first and second tongue plates 13, 14. The first and second tongue plates 13, 14 respectively define a plurality of first and second passageways 131, 141 for receiving the contacts 2 therein. The first passageways 131 are aligned with corresponding second passageways 141 in the vertical direction. The second tongue plate 14 has a guiding face 142 with the second passageways 141 recessed therein. The rear portion 11 has a plurality of mounting holes (not labeled) respectively communication with the first and second passageways 131, 141 for the contacts 2 assembled through the mounting holes. The rear portion 11 further has a pair of engaging plates 16 on a lower position thereof for abutting against the metal shield 3. Each engaging plate 16 has a post 161 receivable in a hole (not shown) of the PCB 7 for fixing the electrical connector on the PCB 7. A pair of triangle-shaped wedges 122, 172 are formed on opposite inner surfaces of the first and second side portions 12, 17. The wedges 122, 172 connect with the front face 111 of the rear portion 11 to enhance a reliable configuration of the insulative housing 1 for mating with the corresponding plug 200. The wedges 122, 172 are respectively located adjacent to the opposite lateral sides of the tongue plates 13, 14. The first and second side portions 12, 17 comprise a pair of upper wing protrusions 121, 171 which face to each other and extend inwardly into the receiving space 18. The wing protrusions 121, 171 and the wedges 122, 172 are adapted for preventing improper connectors inserted into the electrical connector 100. Besides, the wing protrusions 121, 171 respectively define a slant wall 1211, 1711 communicating with the receiving space 18 and a rib 1212, 1712 on upper surfaces thereof for enhancing the connection with the metal shield 3. The slant walls 1211, 1711 are adapted for guiding the corresponding plug 200 smoothly inserted into the electrical connector 100.

The contacts 2 are stamped from a metal sheet for easily manufacturing. Each contact 2 is Z-shaped and comprises a flat body portion 21, a forked portion 22 extending forwardly from a first end of the body portion 21, and a horizontal soldering tail 23 extending rearwardly from a second end of the body portion 21 to be surfaced mounted to the PCB 7. The forked portion 22 includes an upper and a lower sections 221, 222 respectively received in the first and second passageways 131, 132. An upper surface of the lower section 222 is coplanar with the guiding face 142 for easily insertion of the plug 200. The upper section 221 has a contact portion 2211 at a distal end thereof and extending into the mating slot 15. The body portion 21 further has a plurality of barbs 211 for interference engaging with the first passageways 131. The electrical connector 100 can transmit multiple signals simultaneously with the plurality of contacts 2.

The metal shield 3 includes a top wall 31, an opposite bottom wall 32, a pair of side walls 33 connecting the top and bottom walls 31, 32, and a rear wall (not labeled) connecting the rear edge of the top wall 31 and cooperating with the pair of side walls 33. The soldering tails 23 are located inside the rear wall, which means the soldering tails 23 don't extend beyond the rear wall. The top and bottom walls 31, 32 respectively have a pair of engaging fingers 311, 321 stamped therefrom and slantly extending into the receiving space 18 for mating with the plug 200. The top wall 31 further includes a grounding finger 312 disposed between the corresponding engaging fingers 311. The grounding finger 312 is substantially narrower and longer than the engaging fingers 311 of the top wall 31. The grounding finger 312 comprises a free end located nearer to the rear edge of the top wall 31 than those of the engaging fingers 311. The side walls 33 further include a pair of soldering portions 331 extending outwardly to be soldered to the PCB 7.

Figure 5:
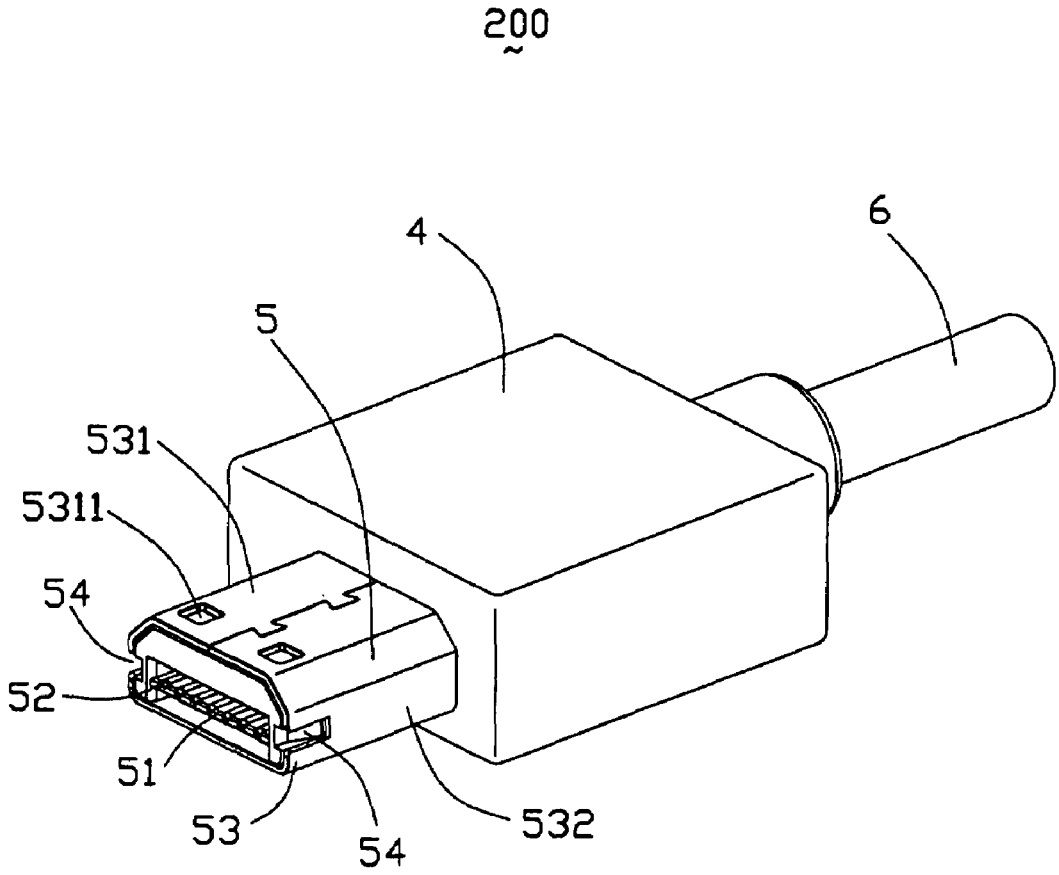
FIG. 5 is a perspective view of a corresponding plug for mating with the electrical connector.

Referring to FIG. 5, the plug 200 includes an insulator 4, a frame 5 protruding forwardly from the insulator 4 and a cable 6 electrically connecting the frame 5. The upper portion of the frame 5 is partially cut to form a pair of inclined edges for mating with the slant walls 1211, 1711 of the wing protrusions 121, 171. The frame 5 comprises a tongue portion 51, a plurality of pads 52 supported on the tongue portion 51 and a rectangle-shaped shell 53 enclosing the tongue portion 51. The shell 53 comprises a top wall 531, an opposite bottom wall and a pair of side walls 532. The top wall 531 defines a couple of engaging holes 5311 for mating with the corresponding engaging fingers 311. Each side wall 532 defines an inclined depress 54 extending inwardly thereof for receiving the wedges 122, 172.

Figure 6:
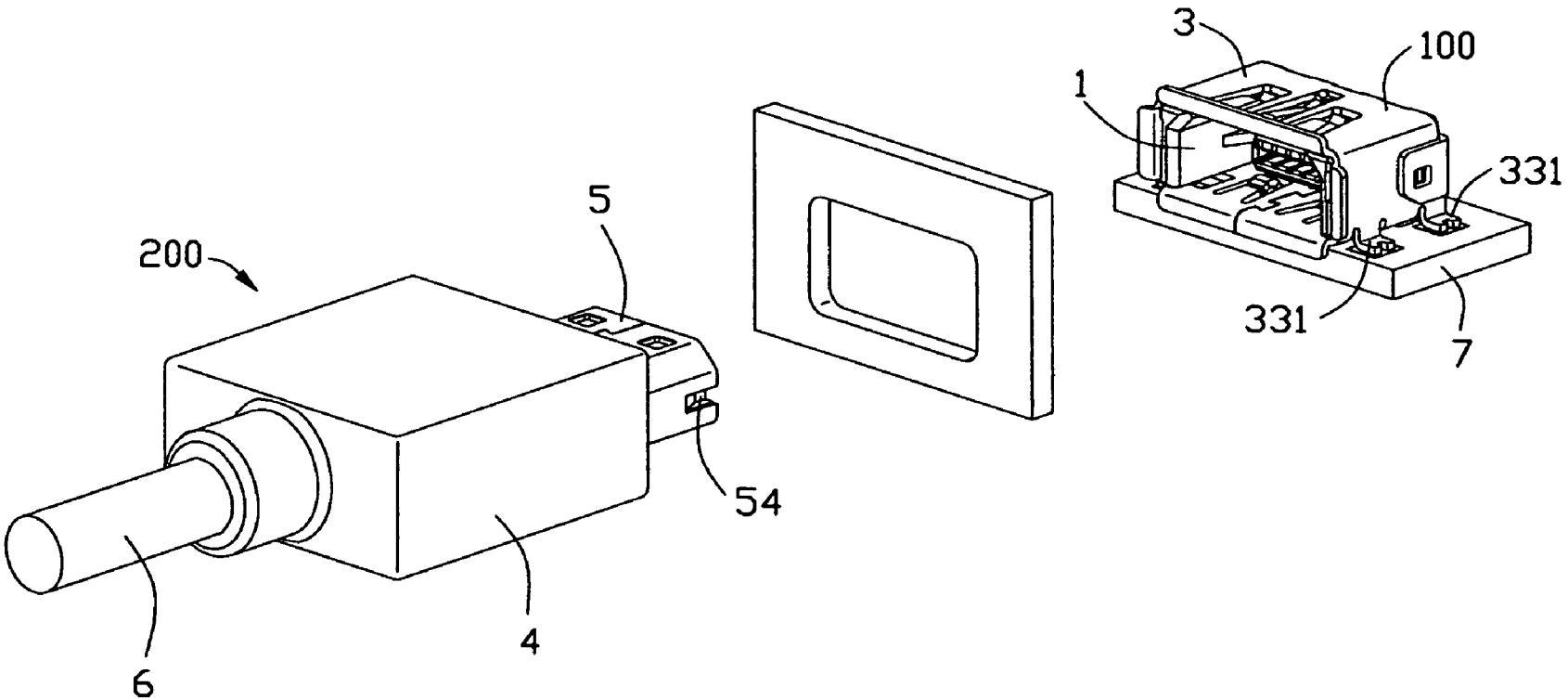
FIG. 6 is a perspective view of an electrical connector assembly before mating the corresponding plug with the electrical connector.
Figure 7:
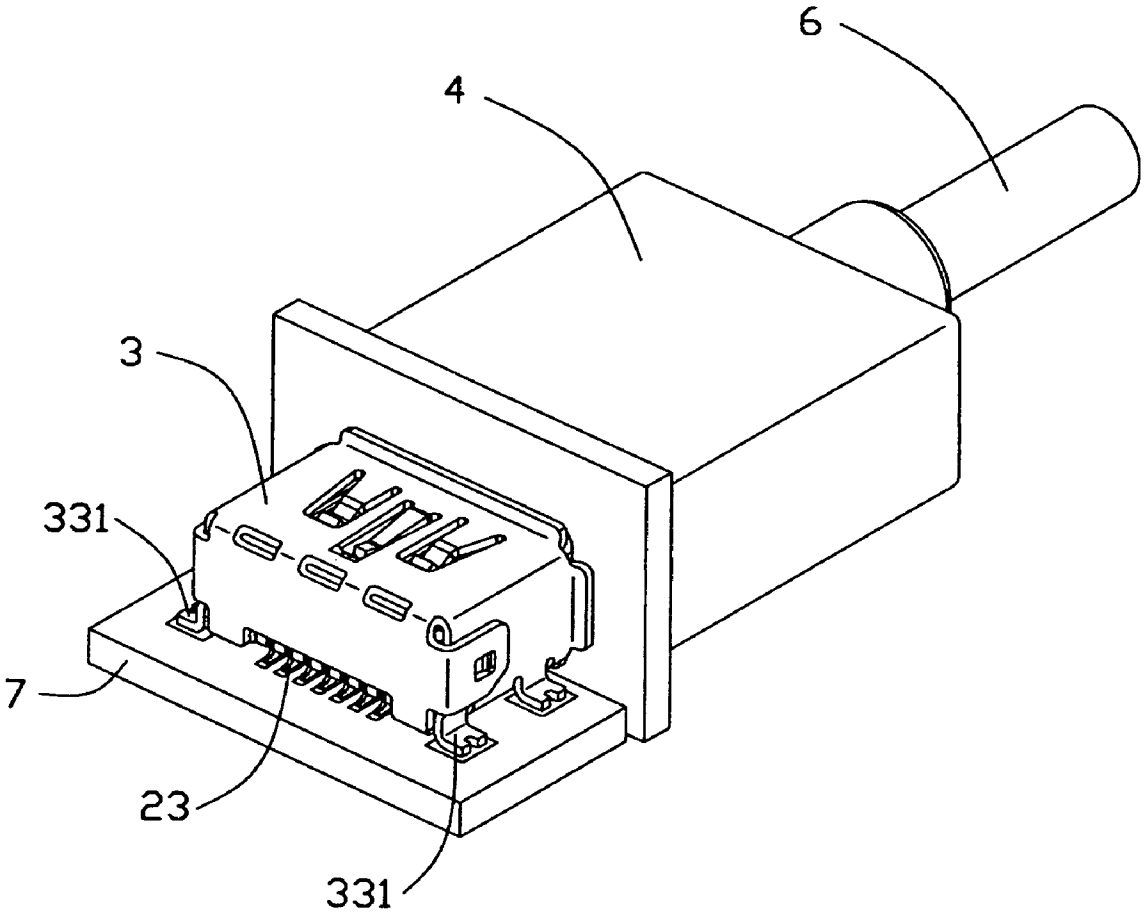
FIG. 7 is a perspective view of the electrical connector assembly of the electrical connector and the plug.

Referring to FIGS. 6 and 7, when the plug 200 is inserted into the electrical connector 100, the frame 5 is received in the receiving space 18 and the tongue portion 51 is inserted into the mating slot 15. The wedges 122, 172 of the first and second side portions 12, 17 are accommodated in the depresses 54. The upper sections 221 of the contacts 2 are elastically deformed in the first passageways 131 to electrically connecting with the pads 52 for transmitting RF signals received by an antenna to the PCB 7.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector, comprising:

an insulative housing having a rear portion and a pair of side portions extending from the rear portion with a receiving space formed therebetween, the rear portion having a pair of upper and lower tongue plates extending forwardly into the receiving space with a mating slot formed between the upper and lower tongue plates, the upper and lower tongue plates defining a plurality of upper and lower passageways, respectively;

a plurality of contacts each having a body portion retained in the rear portion, an upper and a lower section extending from an end of the body portion, and a soldering tail extending from another end of the body portion, the upper and lower sections being respectively received in the upper and lower passageways; and a metal shield enclosing the insulative housing, the metal shield having a top wall and a pair of side walls mating with the pair of side portions of the insulative housing.

2. The electrical connector according to claim 1, wherein each contact comprises a forked portion integrally extending from the body portion, the upper and lower sections being formed on the forked portion.

3. The electrical connector according to claim 1, wherein the side portions extend forwardly from opposite lateral sides of the rear portion, the upper and lower tongue plates being located between the side portions.

4. The electrical connector according to claim 1, wherein the top wall of the metal shield comprises a pair of engaging fingers and a grounding finger located between the pair of engaging fingers, and wherein the grounding finger is narrower than those of the engaging fingers.

5. The electrical connector according to claim 1, wherein the metal shield comprises a rear wall covering the rear portion of the insulative housing, the soldering tails of the contacts don't extend rearwardly beyond the rear wall.

6. The electrical connector according to claim 1, wherein the lower tongue plate comprises a guiding face with the plurality of lower passageways recessed therefrom.

7. The electrical connector according to claim 6, wherein the guiding face is in communication with the mating slot, the lower section having an upper surface coplanar with the guiding face.

8. The electrical connector according to claim 1, wherein the insulative housing comprises a pair of projecting wedges located at two corners formed by the side portions and the rear portion, each projecting wedge protruding into the receiving space and connecting the corresponding side portion and the rear portion.

9. The electrical connector according to claim 8, wherein the wedges are respectively located substantially at opposite lateral sides of the upper and lower tongue plates.

10. An electrical connector, comprising:

a metal shield defining a mating face and a receiving chamber;

an insulative housing received in the receiving chamber, the insulative housing having a rear portion, a first tongue plate extending forwardly from a front face of the rear portion, the first tongue plate defining a plurality of passageways and a distal end opposite to the rear end in condition that the distal end is nearer to the front face than to the mating face; and a plurality of contacts received in the passageways and comprising a plurality of contact portions extending beyond the first tongue plate and into the receiving chamber.

11. The electrical connector according to claim 10, wherein the insulative housing comprises a pair of side portions extending forwardly from lateral sides of the rear portion and cantilevered extending into the receiving chamber, the metal shield comprising a pair of side walls abutting against the side portions.

12. The electrical connector according to claim 10, wherein the insulative housing comprises a second tongue plate under the first tongue plate with a mating slot farmed therebetween, the contact portions protruding into the mating slot.

13. The electrical connector according to claim 12, wherein the contacts comprise a plurality of body portions retained in the rear portion, a plurality of soldering tails extending from an end of the body portions and a plurality of upper sections extending from another end of the body portions with the contact portions disposed at the distal ends thereof.

14. The electrical connector according to claim 13, wherein the second tongue plate defines a plurality of another passageways aligned with the passageways of the first tongue plate in a vertical direction, the contacts comprising a plurality of lower sections received in the another passageways, the second tongue plate comprising a guiding face in communication with the mating slot, the lower sections each having an upper surface coplanar with the guiding face.

15. The electrical connector according to claim 13, wherein the metal shield comprises a rear wall opposite to the mating face, the soldering tails being located inside the rear wall.

16. An electrical connector assembly comprising:

a first connector including a first insulative housing defining a large receiving space with a small mating port at a rear end of the receiving space and with a pair of wedged sections respectively distantly spaced by two sides of said mating port and hidden at said rear end of the receiving space:

a plurality of first contacts disposed in the first housing and extending into the mating part; and a second connector including a second insulative housing defining a large insertion section with a small mating section at a front end of the insertion section and with a pair of tapered recesses formed at two sides of the mating section to receive said pair of wedge sections, respectively;

a plurality of second contacts disposed in the second housing and extending into the mating section.

17. The electrical connector assembly as claimed in claim 16, wherein the pair of tapered recesses are essentially fully outwardly and laterally exposed to an exterior.

18. The electrical connector assembly as claimed in claim 16, wherein the mating section defines a recessed mating chamber with a tongue portion extending into the mating chanter, the second contacts being fixed to the tongue portion and exposed to the mating chamber, the tapered recesses being located out of the mating chamber.

19. The electrical connector assembly as claimed in claim 16, wherein the mating section includes a base and a metal shell enclosing the base, the metal shell comprising a pair of side surfaces with the tapered recesses extending therethrough.

20. The electrical connector assembly as claimed in claim 19, wherein the base includes a pair of side walls abutting against the side surfaces of the metal shell, the tapered recesses further extending into inner sides of the side walls.

* * * * *